US005722567A

United States Patent [19]

Jones et al.

[11] Patent Number: 5,722,567

[45] Date of Patent: Mar. 3, 1998

[54] PREMIX BEVERAGE DISPENSER

[75] Inventors: Brian C. Jones, Collinsville; Robert J. Bordonaro, Torrington, both of Conn.

[73] Assignee: IMI Wilshire Inc., Anoka, Minn.

[21] Appl. No.: 540,845

[22] Filed: Oct. 11, 1995

[51] Int. Cl.[6] ..... B67D 5/62

[52] U.S. Cl. ..... 222/146.6; 222/399; 222/400.7; 285/175

[58] Field of Search ..... 222/146.6, 399, 222/400.7; 285/286, 332.2, 332.3, 355, 175

[56] References Cited

U.S. PATENT DOCUMENTS

| | | | |
|---|---|---|---|
| 1,325,826 | 12/1919 | Baker et al. | 285/332.2 X |
| 2,899,170 | 8/1959 | Cornelius | 251/122 |
| 2,924,238 | 2/1960 | Cornelius | 137/600 |
| 3,231,154 | 1/1966 | Johnston | 222/400.7 |
| 3,464,435 | 9/1969 | Lamb et al. | 222/400.7 X |
| 3,596,810 | 8/1971 | Tawbenheim | 222/400.7 |
| 3,861,569 | 1/1975 | Johnston | 222/400.7 |
| 5,217,261 | 6/1993 | DeWitt et al. | 285/333.2 |
| 5,390,826 | 2/1995 | Burrows | 222/146.6 |
| 5,392,960 | 2/1995 | Kendt et al. | 222/146.6 X |

*Primary Examiner*—Joesph Kaufman

*Attorney, Agent, or Firm*—Vickers Daniels & Young

[57] ABSTRACT

A premix beverage dispensing apparatus is provided with an adapter to eliminate the standard threaded connection between dispensing valves and a premix beverage dispensing tower. The adapter includes a plug-in connector fitting welded at the outlet of the beverage conduit on the dispensing tower and an adapter fitting having one end threaded into the dispensing valve and the other end engaging the plug-in connector fitting.

73 Claims, 4 Drawing Sheets

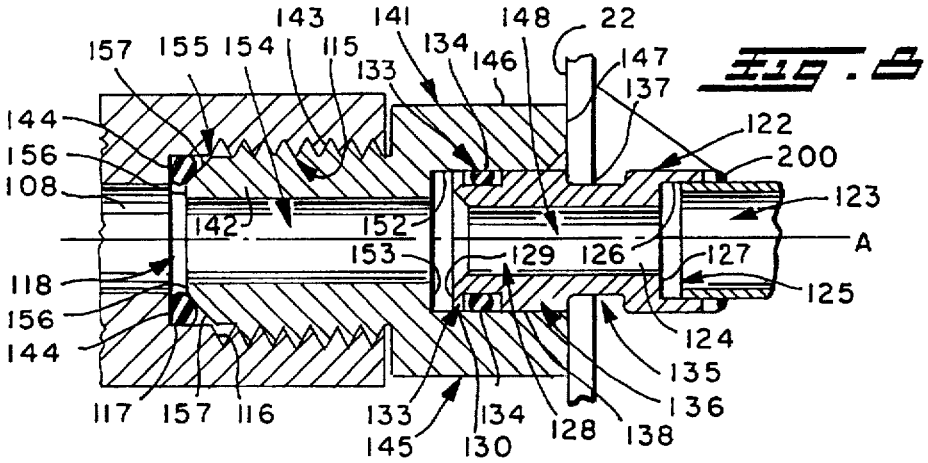

Fig. 8

PROVIDE A PREMIX BEVERAGE DISPENSER INCLUDING A PRODUCT SOURCE STATION FOR PROVIDING A PREMIXED BEVERAGE AND A TOWER ASSEMBLY

↓

PROVIDE A COOLING APPARATUS IN THE TOWER ASSEMBLY DOWNSTREAM OF SOURCE STATION

↓

PROVIDE A DRINK DISPENSING VALVE WITH A THREADED SOCKET

↓

PROVIDE A CONDUIT WITHIN THE TOWER ASSEMBLY FOR INTERCONNECTING THE SOURCE STATION AND THE DISPENSING VALVE THROUGH THE COOLING APPARATUS, THE CONDUIT INCLUDING AN OUTLET END ADJACENT THE VALVE

↓

PROVIDE A PLUG-IN CONNECTOR FITTING

↓

WELD THE PLUG-IN CONNECTOR FITTING TO THE CONDUIT AT THE OUTLET END

↓

RIGIDLY SECURE THE PLUG-IN CONNECTOR FITTING TO THE BEVERAGE DISPENSER WITH FOAM-IN-PLACE INSULATION

↓

PROVIDE AN ADAPTOR FITTING, INCLUDING A THREADED NIPPLE PORTION AND AN AXIALLY OPPOSITE RECEPTACLE OPENING

↓

SCREW THE THREADED NIPPLE PORTION INTO THE THREADED SOCKET

↓

PUSH THE VALVE AND THE RECEPTACLE OPENING OVER THE PLUG-IN CONNECTOR

↓

ROTATE THE VALVE TO A DESIRED ALIGNMENT POSITION

↓

FASTEN THE VALVE INTO POSITION

Fig. 9

PREMIX BEVERAGE DISPENSER

This invention relates to a premix beverage dispenser and in particular to a beverage dispenser with an improved premix valve mounting system and a method for installing a premix valve.

INCORPORATION BY REFERENCE

Cornelius U.S. Pat. No. 2,924,238 and Cornelius U.S. Pat. No. 2,899,170 are incorporated by reference herein so that background premix dispensing valves known in the art need not be described in detail herein.

BACKGROUND OF THE INVENTION

Carbonated beverages are sold in restaurants, fast food outlets, snack shops, amusement parks and other establishments throughout the world. There are generally two kinds of beverage dispensers. A postmix beverage dispenser is provided with separate sources of flavoring syrups and carbonated water. Each of the syrup and carbonated water are chilled and then mixed within the dispenser valve and poured into a cup or glass via the valve. In contrast, a premix beverage dispenser is generally connected to a product tank in which the mixed end product beverage has already been placed. Typically carbon dioxide is added to the product tank. In addition to such carbon dioxide maintaining the carbonation of the product for the consumer, carbon dioxide also provides the pressure head to the beverage dispenser wherein the beverage can be cooled and then poured into a cup or glass by actuating a dispensing valve. In both types of beverage dispensers, it is desirable to dispense beverages at a uniform low temperature. Dispensing of a consistently cold beverage allows better retention of carbonation in the beverage and a more desirable product to the consumer.

There are generally two types of premix beverage dispensers; the mechanically refrigerated type and the cold plate type. The mechanically refrigerated uses refrigerant filled coils to form an ice bank which is surrounded with conduit coils through which beverage product passes. These coils are contained in a water bath for uniform cooling, the water bath being contained within an insulation block. The beverage product tanks are connected to the beverage conduit at one end, the product conduit terminating at the other end in a dispensing valve which is often supported on a tower. A cold plate type premix beverage dispenser utilizes an aluminum block or plate of a similar metal in which the beverage conduits are embedded. Ice is placed in contact with the aluminum block. The ice cools the block, which in turns cools the beverage within the block. The cold plate is also embedded in insulation or a foamed insulation block as are the beverage conduits which lead from the cold plate to the beverage dispensing valves. Cold beverages can then be dispensed.

During peak dispensing times, when a restaurant is serving lunch or the like, the flow of beverage through either type of premix beverage dispenser is regular and high. A uniformly chilled product is generally provided. However, in off peak times, beverages can sit for a long period of time in the conduits within the tower, between the cold plate and the dispensing valves. The beverage naturally warms due to exposure to ambient conditions, though such warming is slowed by the insulation. This warmer than usual, or less than optimal drink, is generally referred to as the casual drink problem. Applicant has found that the casual drink problem is exacerbated with the conventional connection used to attach premix beverage dispensing valves to the dispensing tower.

The dispensing valves shown in Cornelius U.S. Pat. No. 2,899,170 and Cornelius U.S. Pat. No. 2,924,238 are typical of existing premix dispensing valves. Connections to these valves are limited to threaded type fittings. The threaded fittings require a threaded socket on one of the tower or valve and a threaded stud on the other of the tower or valve for fitment of the valve to the tower.

A major disadvantage of threaded fittings is the need to have access behind the valve to facilitate connection to the threaded fitting. One way to improve this access, is to locate the premix valve further forward in front of the dispensing tower. This results in a number of disadvantageous features. For instance, it causes a larger dispenser footprint, requiring a larger counterspace or other location dedicated to the dispenser. Further, misalignment between the valves and the drip pan is another undesirable result. Thus the purpose of such a drip pan, to catch overflows or spills from the dispenser, is negated. Importantly, creating access for threaded fittings also requires a greater length of beverage tubing or conduit exposed outside of the foamed insulation. As a result, casual drink temperatures significantly increase, negating advantages achieved from the foamed insulation. Other disadvantages of threaded fittings include increased service time to repair or replace premix valves and the greater probability of leaks which result from threaded fittings as compared to other types of fittings.

SUMMARY OF THE INVENTION

In accordance with the present invention there is provided a premix beverage dispenser which is provided with an improved premix valve mounting system.

In accordance with the invention an improved premix beverage dispenser comprising a product source station for providing at least one premix beverage, a cooling apparatus for chilling the premix beverage downstream of the source station, a tower assembly, and at least one drink dispensing valve is provided. A conduit for interconnecting the source station and the dispensing valve is provided. The conduit includes an inlet end adjacent the source station and between the source station and cooling apparatus and an outlet side located within the tower assembly extending from the cooling apparatus to a point adjacent the valve, the outlet side fixed in a foam insulation block. The dispensing valves include a dispensing end and an opposite connection end for fitting the valve to the outlet side of the conduit. In accordance with the invention, a plug-in connector is provided and fixed at the outlet point of the conduit. An adapter is provided and attached to the dispensing valve, wherein the plug-in connector is received within a receptacle of the adapter.

In accordance with another feature of the invention, the plug-in connector includes a machined circumferential groove and an O-ring disposed thereon. The adapter includes a threaded nipple portion engaging with a threaded socket of the valve and is seated against a gasket provided therein.

Still further in accordance with the invention, the adapter is provided with a receptacle axially opposite the nipple portion, the receptacle having a cylindrical opening, the plug-in connector and O-ring received therein.

In accordance with another aspect of the invention, a method of assembling valves to a premix beverage dispensing apparatus is provided. The method includes providing a product source station for providing at least one premix beverage, providing a tower assembly, providing a cooling apparatus within the tower assembly for chilling the premix beverage downstream of the source station, providing at least one drink dispensing valve and at least one conduit for interconnecting the source station and the drink dispensing valve, providing the conduit with an inlet end adjacent the source station and an outlet side extending from the cooling apparatus to a point adjacent the valve, fixing the outlet side in a foam insulation block, providing a plug-in connector, and welding the plug-in connector to the outlet side of the conduit, providing an adapter for interconnecting the plug-in connector and the threaded socket of the valve, the adapter including a threaded nipple portion and a receptacle axially opposite the nipple portion, screwing the threaded nipple portion into the threaded socket, placing the receptacle over the plug-in connector, pushing the receptacle over the plug-in connector until the plug-in connector seats within the receptacle, rotating the valve to a desired position and fastening the valve into a final position.

It is primary object of the present invention to reduce the casual drink temperature problem by providing an improved premix dispenser valve mounting system.

It is another object of the present invention to provide an improved premix valve mounting system which does not require access behind the valve to facilitate connection to the tower assembly fitting.

It is still another object of the present invention to improve access to a premix valve mounted on a tower assembly while reducing the length of beverage conduit exposed to ambient conditions outside of the foamed insulation.

It is still yet another object of the present invention to improve the space requirements of a premix dispenser by reducing the footprint of a premix dispenser by mounting premix dispensing valves closer to the tower assembly.

It is yet another object of the present invention to provide a premix valve mounting system which improves alignment between premix beverage dispensing valves and the drip pan of the beverage dispenser.

It is still another object of the present invention to provide an improved premix valve mounting system which decreases service time to repair or replace premix valves.

It is still yet another object of the present invention to provide an improved premix valve mounting system which decreases the probability of leaks in standard threaded fittings between premix valves and the tower assembly.

These and other objects of the invention will become apparent to those skilled in the art upon reading and understanding the detailed descriptions in the following section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein:

FIG. 8 is a detailed cross-section of the adapter assembly in accordance with the present invention; and, FIG. 9 is a flow diagram showing a method of assembling the present invention.

THE PREFERRED EMBODIMENT

Figure 1:
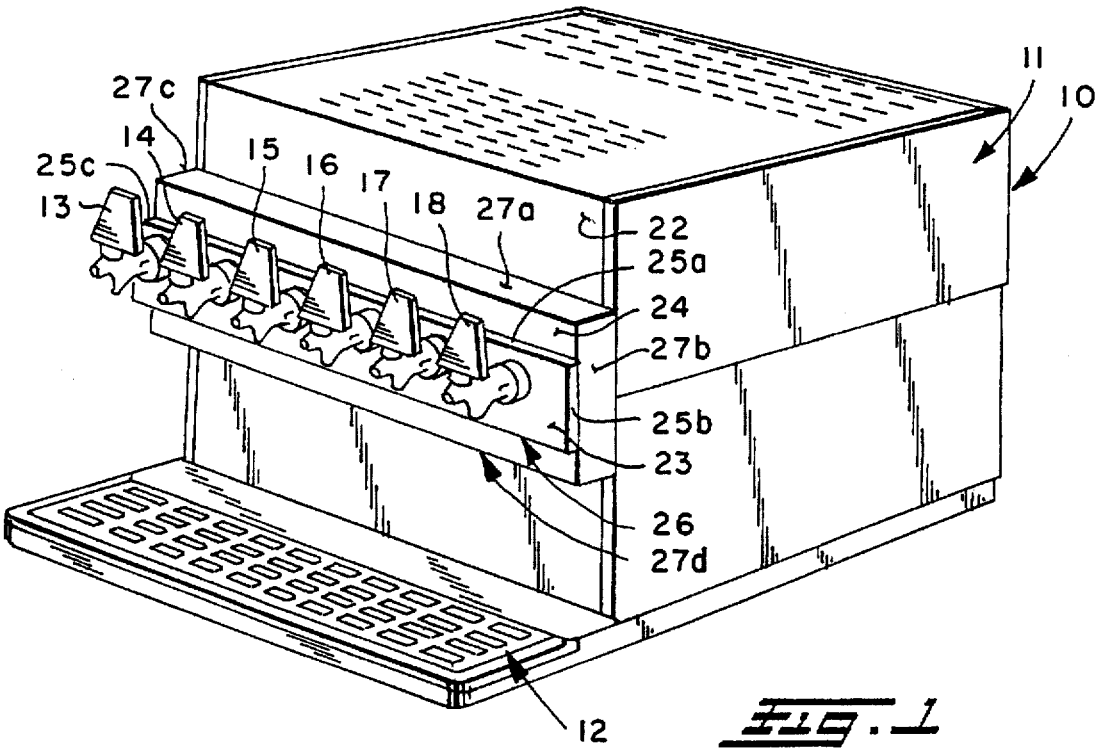
FIG. 1 is a perspective view of a premix beverage dispenser according to the invention.

Referring now to the drawings, wherein the showings are for the purpose of illustrating a preferred embodiment of the invention only and not for the purpose of limiting same, FIG. 1 shows a premix beverage dispenser 10 including a tower assembly 11 and a drip tray 12. Several premix dispensing valves 13, 14, 15, 16, 17 and 18 are attached to a front face plate 22 of tower assembly 11. Each of dispensing valves 13–18 is shown attached to a premix valve preassembly plate 23 which is in turn attached to a valve mounting plate 24. Valve mounting plate 24 is then attached to front face plate 22 of tower assembly 11. Extending perpendicular from preassembly plate 23 are three preassembly edge walls **25*a*, 25*b* and 25*c*, which are in contact with valve mounting plate 24. One of preassembly edge walls, 25*a*, is upwardly facing while the other two of preassembly edge walls 25*b* and 25*c* are opposite, parallel and located transverse to upwardly facing preassembly edge wall 25*a*. A downwardly facing rectangular opening 26, opposite drip tray 12, exposes the interior of preassembly plate 23 for purposes to be described hereinafter. In an alternative embodiment (not shown) rectangular opening 26 may be covered with a removable access cover. Additionally, extending perpendicular from valve mounting plate 24 are the four perimeter edge walls 27*a*, 27*b*, 27*c* and 27*d*, which are in contact with front face plate 22**.

Figure 2:
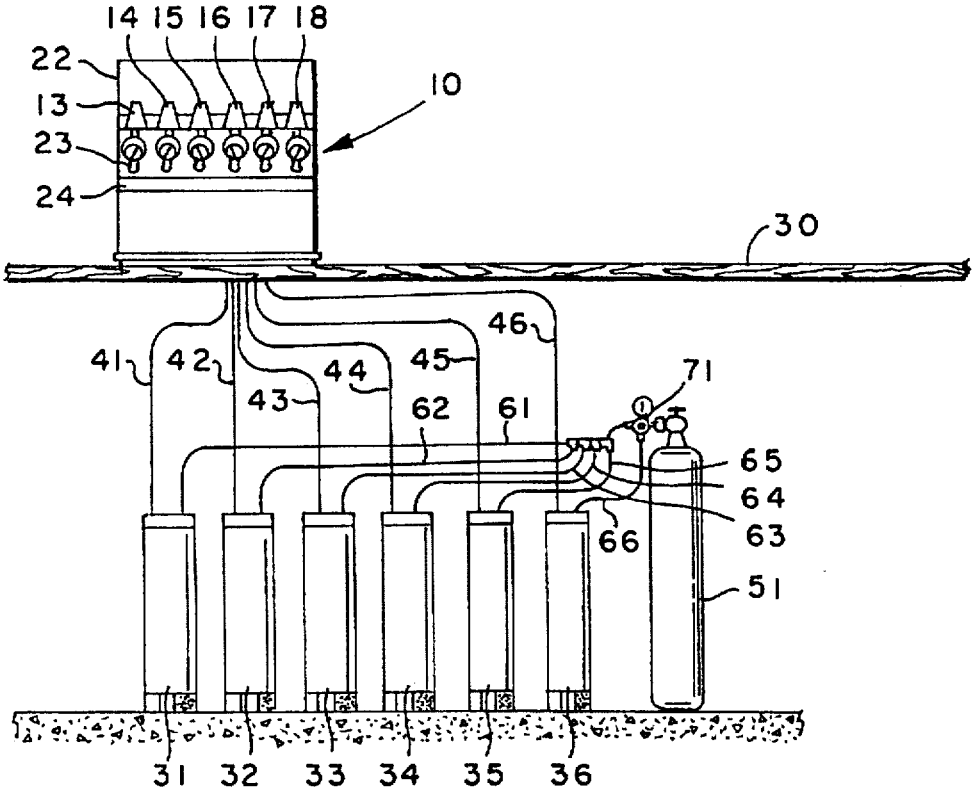
FIG. 2 is a pictorial view showing an installation of the beverage dispenser of FIG. 1.
Figure 3:
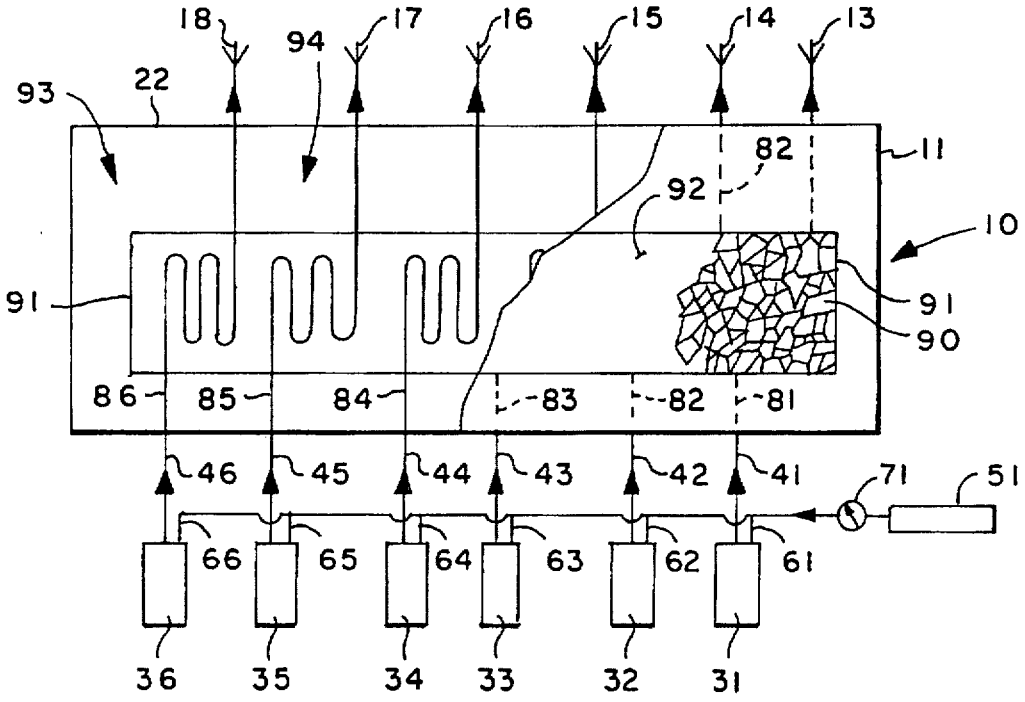
FIG. 3 is a pictorial cross-sectional diagram of a typical premix dispensing unit of FIG. 1.
Figure 4:
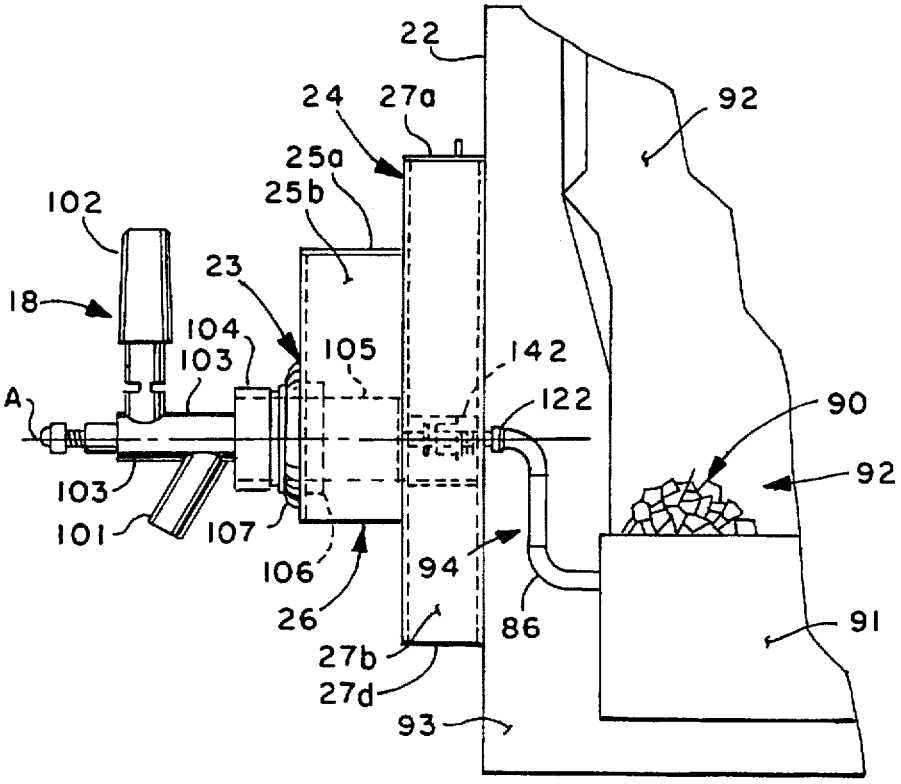
FIG. 4 is a cross-sectional elevation view of the premix valve mounting system of the present invention.
Figure 5:
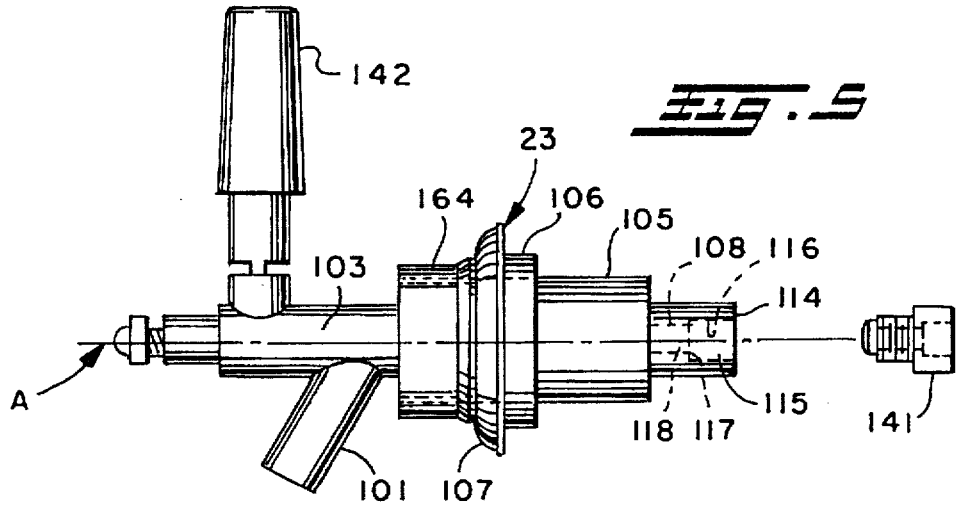
FIG. 5 shows the valve assembly in accordance with the present invention.
Figure 6:
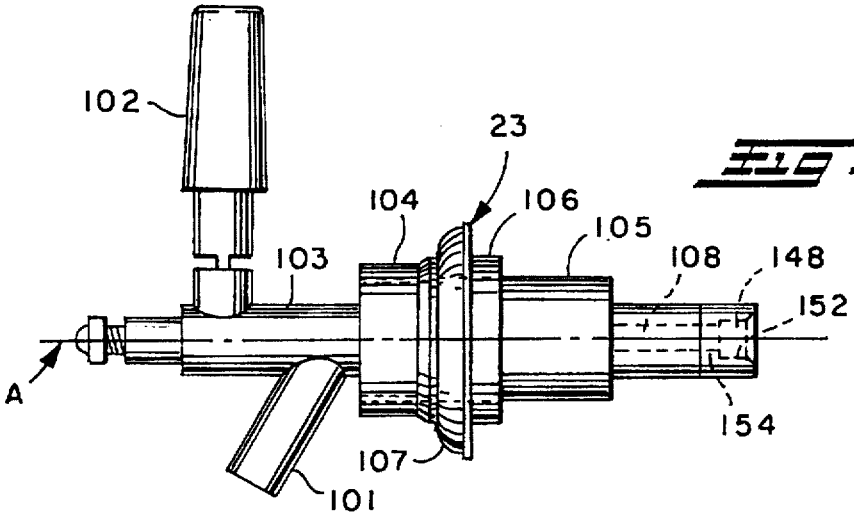
FIG. 6 shows a premix beverage dispensing valve modified in accordance with the present invention.

FIGS. 2 and 3 generally show the flow path for a typical premix beverage dispensing unit according to the present invention. As shown, beverage dispensing unit 10 is located on countertop 30 and is attached to the beverage product tanks 31, 32, 33, 34, 35 and 36 via the beverage supply lines 41, 42, 43, 44, 45 and 46, respectively. Carbon dioxide is delivered to product tanks 31–36 from the carbon dioxide supply lines 61, 62, 63, 64, 65 and 66, respectively. The flow of carbon dioxide ($CO_2$) is controlled by a tank mounted pressure regulator 71. Each of beverage supply lines 41–46 are connected to premix beverage dispensing unit 10 at the beverage conduits 81, 82, 83, 84, 85 and 86. Beverage conduits 81–86 are located within tower assembly 11 and are embedded within an aluminum cold plate 91. The ice 90, contained within an ice chest 92, is in contact with cold plate 91. This acts to chill cold plate 91, beverage conduits 81–86, and the beverage product therein. As shown, cold plate 91 and ice chest 92 are encased within a rigid foam insulation block 93. It will be appreciated that some premix beverage dispensers include mechanical refrigeration wherein ice can be made within the tower assembly and continuously placed within ice chest 92. In the preferred embodiment of this invention, ice is manually placed within ice chest 92. In another embodiment, not shown, a mechanical refrigeration unit produces an ice bank which is adjacent beverage conduits. Beverage product passing through the beverage conduits are chilled to the desired temperature.

At the outlet side 94 of cold plate 91, beverage conduits 81–86 pass through foam insulation block 93 and terminate at front face 22 of dispensing unit 10. Each of beverage conduits 81–86 are releasably attached to dispensing valves 13–18 by the adapter fitting which will be described in greater detail hereafter.

Dispensing valves 13–18, as known in the prior art, will be described with reference to valve 18 as shown in FIGS. 4–8. It will be appreciated that each of dispensing valves 13–17 are identical to dispensing valve 18. Premix dispensing valve 18 has a spout 101 and an operating handle 102 defining an outlet or dispensing end, to actuate the valve between open and closed positions. Both spout 101 and operation handle 102 extend from a shank portion 103 which is coaxial about a dispensing axis A. Assembly nut 104 engages a threaded portion of a valve shank 103 to connect valve shank 103 to valve shaft 105 by the interengagement of the abutting surfaces 110 and 111. Valve 18 is also provided with a jam nut 106 which is threaded on valve shaft 105. Collar 107 also encircles shaft 105 adjacent assembly nut 104 and abuts against preassembly plate 23 opposite jam nut 106. Jam nut 106 is tightened against preassembly plate 106 order that valve 18 is positioned tightly in its final position. A dispensing conduit 108 is located within valve 18 and is coaxial with dispensing axis A. At the outlet end of dispensing conduit 108 is spout conduit 109 located within spout 101. At the inlet or connection end 114 of valve 18 is a threaded socket 115, coaxial with dispensing axis A. The threaded circumferential side wall 116 of threaded socket 115 is open to inlet end 114 and terminates at a bottom flange 117 defining the inlet opening 118 of dispensing conduit 108.

Figure 7:
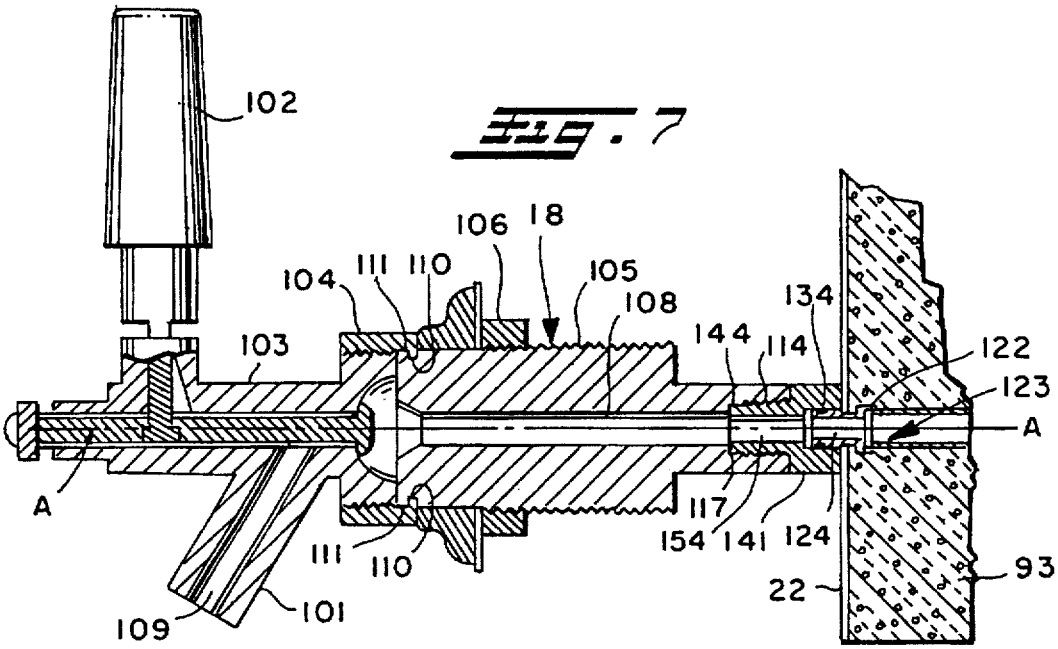
FIG. 7 is a cross-section of the valve mounting system in accordance with the present invention.

As best shown in FIGS. 7 and 8, a male plug-in connector fitting 122, coaxial with dispensing axis A, is attached and preferably welded at the outlet opening 123 of each of beverage conduits 81–86. Plug-in connector 122 includes a central bore 124 having an inside diameter similar to the inside diameter of each of beverage conduits 81–86. A recessed portion 125 of plug-in connector 122 is defined by an edge wall 126 and bottom flange 127. Edge wall 126 is placed over the outer circumference of each of beverage conduits 81–86 and welded thereon via circumferential weld 200. Axially opposite recessed portion 125 of plug-in connector 122 is an end section 128 having an outer flange 129 extending between central bore 124 and the outer circumferential wall 130 of plug-in connector 122.

A circumferential groove 133 is machined within outer circumferential wall 130 adjacent flange 129. An O-ring 134 is disposed therein. Adjacent recessed portion 125 is a second circumferential groove 135. Disposed between each of circumferential grooves 133 and 135 is a cylindrical portion 136 of plug-in connector 122 having an outer cylindrical surface 138 with an outside diameter greater than each of circumferential grooves 133, 135 and generally equal to the outside diameter of outer circumferential wall 130. Plug-in connector 122 is secured in its exact position extending from beverage dispenser 10 by providing a key slot 137 within front face plate 22 adjacent the outlet opening 123 of each of beverage conduits 81–86. Key slot 137 engages plug-in connector 122 at second circumferential groove 135 and retains connector 122 in place. Once connector 122 has been welded in place and positioned relative to front plate 22, rigid foam insulation block 93 is provided by a foam-in-place operation, as is well known. Thus, plug-in connector 122 is rigidly fixed relative to face plate 22 within beverage dispenser 10.

An adapter fitting 141 is provided along dispensing axis A with each of dispensing valves 13–18 to connect the valves to plug-in connector 122. A threaded nipple portion 142 having a threaded outer section 143 is adapted to screw into threaded socket 115 and is seated against an O-ring gasket 144 which is placed against bottom flange 117 of threaded socket 115. Axially opposite threaded nipple portion 142 is a head portion 145 defined by an outer head wall 146 coaxial with dispensing axis A and an abutment flange surface 147 perpendicular to head wall 146. A cylindrical receptacle opening 148 extends within head portion 145 from abutment flange surface 147. Receptacle opening 148 is defined by a cylindrical surface 152, coaxial with axis A, which terminates at a receptacle flange 153 which is perpendicular to axis A and parallel to abutment flange surface 147.

An adapter conduit 154, also coaxial with axis A, extends from receptacle flange 153 through threaded nipple portion 142. Axially opposite receptacle flange 153 is a frusto-conical end section 155 comprised of a rim surface 156 and a frusto-conical surface 157 extending from rim surface 156 outwardly towards threaded outer section 143 of threaded nipple portion 142.

As shown, adapter fitting 141 is screwed within threaded socket 115 of the dispensing valve until it engages O-ring gasket 144. Compression of O-ring gasket 144 by frusto-conical end section 155 and specifically frusto-conical surface 157, against bottom flange 117 causes a watertight seal between dispensing valve and adapter fitting 141. Any of premix dispensing valves 15–18 may then be placed over plug-in connector fitting 122 wherein outer cylindrical surface 138 of cylindrical portion 136, O-ring 134 and circumferential wall 130 are within cylindrical surface 152 of adapter fitting 141. At least O-ring 134 is in abutting contact with cylindrical surface 152 to provide a watertight seal between adapter fitting 141 and plug-in connector 122. It will be appreciated that adapter fitting 141 is freely rotatable and axially slidable along axis A relative to plug-in connector 122. The connection between adapter fitting 141 and plug-in connector 122 eases assembly of premix dispensing valves to beverage dispenser 10 since dispensing valves may be easily inserted into place and then aligned even after a good watertight seal has been achieved. Thus, with the present invention, a valve may be initially placed on the tower assembly in a misaligned position, but with a watertight seal. Optimum alignment may then be achieved all the while maintaining the watertight seal. Achieving this optimal alignment of a dispensing valve while obtaining or retaining watertight seal was very difficult with the threaded premix valve connections in the prior art, since the dispensing valve was connected to the beverage dispenser by screwing the valve onto a threaded post. Misalignment may lead to deformation or damage to elements of the dispenser.

The invention makes it much easier to install, repair or replace premix valves and reduces the probability of leaks found in threaded fittings as compared to plug-in fittings. As discussed hereinabove, premix valves that are typical in the industry, utilize threaded fittings to connect the valve to the beverage dispenser. These types of typical connections utilize a threaded male connector which is welded onto the outlet of conduits 81–86. Such procedure results in major manufacturing problems. A major disadvantage of threaded fittings is the need to have access behind the valve to facilitate connection to the threaded fittings. Creating access for threaded fittings also requires a greater length of beverage tubing exposed outside of the foamed-in-place insulation. As a result, casual drink temperatures significantly increase. As discussed above, a casual drink is a drink dispensed after a long inactive period without use of the dispenser. The fluids in the dispenser tubing may have warmed during this inactive period. Thus, the drink dispensed may be undesirably warm to the consumer. Other disadvantages of threaded fittings are increased service time to repair or replace premix valves and the greater probability of leaks in threaded fittings because of stresses imposed on the threaded connection by misalignments. The present invention lessens the possibility of leaks and does not require such access.

The plug-in design of the present invention solves the disadvantages of using premix valves with threaded connectors. In accordance therewith, a method of assembling valves to a premix beverage dispensing apparatus is provided, as best shown in FIG. 9. The plug-in connector 122 is provided and welded to one of the beverage conduits 81–86. The adapter fitting 141 is screwed into threaded socket 115. Adapter fitting 141 and associated receptacle opening 148 is placed over plug-in connector 122 and pushed over plug-in connector 122 wherein plug-in connector 122 is seated within receptacle opening 148, the dispensing valve can then be rotated to the desired position, tightened against pre-assembly plate 23 by the tightening of jam nut 106 and fastened into position by screwing preassembly plate 23 to valve mounting plate 24 to prevent further rotation. In one embodiment, rectangular opening 26 provides access to valve shaft 105 and specifically jam nut 106, intermediately between dispensing or outlet end and inlet or connection end 114, for attaching and removing valves 13–18 without removing preassembly plate 23. By engaging and rotating jam nut 106 against pre-assembly plate 23, shank portion 103 may be rotated and tightened so that the dispensing end of valves 13–18 are placed in the desired upright dispensing position as shown in FIGS. 1 and 2. It will be appreciated that opening 26 allows that upon loosening jam nut 106, valve 18 may be removed from preassembly plate 23 until adapter fitting 141 is withdrawn from plug-in connector 122, whereby jam nut 106 may be completely removed from valve shaft 105. This allows valve 18 to be completely withdrawn from preassembly plate 23 and beverage dispenser 10 for repair or replacement. It will also be appreciated that, instead of opening 26, a removable cover may be provided to allow the access to jam nut 106. Alternatively, the premix valves are pre-assembled to preassembly plate 23 with jam nut 106 and fitted with adapter fitting 141 prior to installation. Thus, preassembly plate 23 is attached to tower assembly 11 at the same time valves 13–18 are installed.

The invention has been described with reference to the preferred embodiments. It will be appreciated that modifications or alterations could be made without deviating from the present invention. For instance, a dispensing valve may be provided without threaded socket portion 115 and instead provided with a receptacle opening similar to receptacle opening 148 in head portion 145 of adapter fitting 141. This change of a standard premix dispensing valve, made in combination with a plug-in connector similar to that described herein, could be utilized to eliminate the threaded connection between adapter fitting 141 and a dispensing valve. Additionally, the orientation of connector 122 (male connector) and receptacle opening 148 (female connector) may be reversed so that a sufficient male connector is attached to a dispensing valve, while a sufficient female connector is attached to beverage conduits 81–86.

Having thus described the invention, it is claimed:

1. A premix beverage dispensing apparatus including a product source station for providing at least one premixed beverage, a tower assembly, cooling means for chilling said premixed beverage downstream of said source station, at least one drink dispensing valve and conduit means for interconnecting said source station and said dispensing valve, said conduit means including an inlet end adjacent said source station and an outlet side within said tower assembly extending from said cooling means to an outlet end adjacent said valve, said outlet side fixed in an insulation block, said dispensing valve including a threaded socket, the improvement comprising: adapter means for connecting said valve to said outlet end along a common dispensing axis, including a plug-in connection fixed at said outlet end of said beverage conduit, said connector including a circumferential groove and an O-ring disposed therein and an adapter fitting interconnecting said plug-in connector and said threaded socket of said dispensing valve, said adapter fitting including a threaded nipple portion engaging with said threaded socket and seated against a gasket disposed therein, a head portion axially opposite said nipple portion, said head portion having a cylindrical receptacle opening, said plug-in connector and said O-ring fitted therein.

2. The beverage dispenser of claim 1, wherein said plug-in connector has an outer circumferential wall having a diameter, said head portion having an inner cylindrical surface defining said cylindrical receptacle opening having an inner diameter, said outer circumferential wall diameter being less than said receptacle opening inner diameter.

3. The beverage dispenser of claim 2, wherein said O-ring has an inner and external diameter, said external diameter equal to or slightly greater than said receptacle opening inner diameter.

4. The beverage dispenser of claim 3, wherein said external diameter of said O-ring seats within said receptacle opening to form a watertight seal.

5. The beverage dispenser of claim 1, wherein said plug-in connector includes an outer circumferential wall, said circumferential groove located on said circumferential wall.

6. The beverage dispenser of claim 1, wherein said plug-in connector has an end section defined by a circumferential wall and a cylindrical portion defined by an outer cylindrical surface, said circumferential groove disposed between said end section and said cylindrical portion.

7. The beverage dispenser of claim 6, wherein said circumferential wall has a diameter and said outer cylindrical surface has a diameter, said outer circumferential wall diameter being generally equal to said outer cylindrical surface diameter.

8. The beverage dispenser of claim 7, wherein said circumferential wall diameter and said outer cylindrical surface diameter define an outer diameter of said connector.

9. The beverage dispenser of claim 7, wherein said circumferential groove has a diameter, said circumferential groove diameter less than said circumferential wall diameter.

10. The beverage dispenser of claim 9, wherein said O-ring has an inner and an external diameter, said inner diameter less than said circumferential wall diameter.

11. The beverage dispenser of claim 10, wherein said external diameter of said O-ring seats within said receptacle opening to form a watertight seal.

12. The beverage dispenser of claim 1, wherein said O-ring seats against said cylindrical receptacle opening to form a tight seal.

13. The beverage dispenser of claim 1, wherein said adapter means fitting has a frusto-conical end section axially adjacent said threaded nipple portion.

14. The beverage dispenser of claim 13, wherein said frusto-conical end section seats against said gasket to form a tight seal.

15. The beverage dispenser of claim 13, wherein said threaded nipple portion includes a threaded outer surface and said frusto-conical end section includes a rim surface and a frusto-conical surface extending between said rim surface and said threaded outer surface.

16. The beverage dispenser of claim 15, wherein said frusto-conical surface seats against said gasket to form a tight seal.

17. The beverage dispenser of claim 15, wherein said rim surface is generally perpendicular to said dispensing axis, said frusto-conical surface extending outwardly at an angle from said rim surface to said threaded outer surface.

18. The beverage dispenser of claim 17, wherein said frusto-conical surface seats against said gasket to form a tight seal.

19. The beverage dispenser of claim 1, wherein said gasket is a second O-ring.

20. The beverage dispenser of claim 1, wherein said cylindrical receptacle opening is defined by an inner cylindrical surface, said plug-in connector including an outer circumferential wall, a flange at an end section thereof, said flange defined by an outer circumferential wall at an outer diameter, said circumferential wall adjacent said circumferential groove, said O-ring engaging said inner cylindrical surface for a tight seal.

21. A method of assembling valves to a premix beverage dispensing apparatus comprising:

providing a product source station for providing at least one premixed beverage;

providing a tower assembly;

providing a cooling apparatus downstream of said source station for chilling said premixed beverage;

providing at least one drink dispensing valve;

providing at least one conduit for interconnecting said source station and said dispensing valve, said conduit including an inlet side extending between said source station and said cooling apparatus and an outlet side within said tower assembly between said cooling apparatus and said valve, said outlet side including an outlet end adjacent said valve;

providing said at least one drink dispensing valve with a threaded socket;

providing a plug-in connector fitting;

welding said plug-in connector fitting to said at least one conduit at said outlet end;

providing an adapter fitting for interconnecting said plug-in connector fitting and said threaded socket, said adapter fitting including a threaded nipple portion and a receptacle opening axially opposite said nipple portion;

screwing said threaded nipple portion into said threaded socket;

pushing said valve and said receptacle opening over said plug-in connector;

rotating said valve to a desired portion; and fastening said valve into said position.

22. The method of claim 21, further including the steps of providing a gasket and placing said gasket in said threaded socket.

23. The method of claim 21, further including the steps of providing said plug-in connector with an outer surface and machining a circumferential groove within said outer surface and placing an O-ring in said circumferential groove.

24. A premix beverage dispensing apparatus including a product source station for providing at least one premixed beverage, a tower assembly, cooling means for chilling said premixed beverage downstream of said source station, at least one drink dispensing valve and conduit means for interconnecting said source station and said dispensing valve, said conduit means including an inlet end adjacent said source station and an outlet side within said tower assembly extending from said cooling means to an outlet end adjacent said valve, said outlet side fixed in an insulation block, said dispensing valve including a threaded socket, the improvement comprising: adapter means for connecting said valve to said outlet end, including a plug-in connector fixed at said outlet end of said beverage conduit and an adapter fitting interconnecting said plug-in connector and said threaded socket of said dispensing valve.

25. The beverage dispenser of claim 24, wherein said threaded socket includes a gasket disposed therein.

26. The beverage dispenser of claim 24, wherein said plug-in connector includes a flange end at its outlet and further includes a circumferential groove adjacent said flange end.

27. The beverage dispenser of claim 26, wherein an O-ring is disposed within said circumferential groove.

28. The beverage dispenser of claim 24, wherein said plug-in connector includes a flange end at its outlet, an outer surface and an O-ring disposed on said outer surface adjacent said flange end.

29. The beverage dispenser of claim 24, wherein said adapter fitting includes a threaded nipple portion engaging with said threaded socket of said dispensing valve.

30. The beverage dispenser of claim 29, wherein said adapter fitting further includes receptacle means for receiving said plug-in connector therein.

31. The beverage dispenser of claim 30, wherein said receptacle means includes a cylindrical receptacle opening.

32. The beverage dispenser of claim 29, wherein said adapter means connects said valve and said beverage conduit along a dispensing axis, said adapter fitting further including a head portion axially opposite said nipple portion, said head portion including a receptacle means for receiving said plug-in connector.

33. The beverage dispenser of claim 24, wherein said adapter fitting includes receptacle means for receiving said plug-in connector.

34. The beverage dispenser of claim 33, wherein said receptacle means includes a cylindrical receptacle opening, said plug-in connector fitted therein.

35. The beverage dispenser of claim 33, wherein said plug-in connector includes an outer surface and an O-ring disposed thereon.

36. The beverage dispenser of claim 33, wherein said plug-in connector includes a flange end at its outlet, an outer surface and a circumferential groove in said outer surface adjacent said flange end of said connector.

37. The beverage dispenser of claim 36, wherein an O-ring is disposed within said circumferential groove.

38. The beverage dispenser of claim 33, wherein said threaded socket includes a gasket disposed therein.

39. The beverage dispenser of claim 38, wherein said adapter fitting includes a threaded nipple portion engaging with said threaded socket.

40. A premix beverage dispensing apparatus including a product source station for providing at least one premixed beverage, a tower assembly, cooling means for chilling said premixed beverage downstream of said source station, at least one drink dispensing valve and conduit means for interconnecting said source station and said dispensing valve, said conduit means including an inlet end adjacent said source station and an outlet side within said tower assembly extending from said cooling means to an outlet end adjacent said valve, said dispensing valve including a dispensing end and an opposite connection end for fitting said valve to said outlet side of said conduit means, the improvement comprising: a plug-in connector fixed at said outlet end of said conduit means, said plug-in connector rigidly fixed in an insulation block, and receptacle means at said connection end of said valve for interconnecting with said plug-in connector, said connector received and seated within said receptacle means.

41. The beverage dispenser of claim 40, wherein said plug-in connector includes a connector outlet, a flange end at said connector outlet and further includes a circumferential groove adjacent said flange end.

42. The beverage dispenser of claim 41, wherein an O-ring is disposed within said circumferential groove.

43. The beverage dispenser of claim 40, wherein said plug-in connector includes a flange end at its outlet, an outer surface and an O-ring disposed on said outer surface adjacent said flange end.

44. The beverage dispenser of claim 40, wherein said receptacle means includes a cylindrical receptacle opening.

45. The beverage dispenser of claim 40, wherein said receptacle means is removable further relative to said connection end of said valve.

46. The beverage dispenser of claim 45, wherein said receptacle means includes a cylindrical receptacle opening.

47. The beverage dispenser of claim 45, wherein said plug-in connector includes a flange end at its outlet, an outer surface and an O-ring disposed on said outer surface adjacent said flange end.

48. The beverage dispenser of claim 45, wherein said plug-in connector includes a flange end at its outlet and further includes a circumferential groove adjacent said flange end.

49. The beverage dispenser of claim 48, wherein an O-ring is disposed within said circumferential groove.

50. A premix beverage dispensing apparatus including a product source station for providing at least one premixed beverage, a tower assembly, cooling means for chilling said premixed beverage downstream of said source station, at least one drink dispensing valve and conduit means for interconnecting said source station and said dispensing valve, said conduit means including an inlet end adjacent said source station and an outlet side within said tower assembly extending from said cooling means to an outlet end adjacent said valve, said outlet side fixed in an insulation block, said dispensing valve including a threaded socket, the improvement comprising: a plug-in connector fixed at said outlet end of said conduit means along a dispensing axis, and receptacle means for connecting said threaded socket to said plug-in connector, said receptacle means axially slidable and freely rotatable relative to said plug-in connector, said connector received and seated within said receptacle means.

51. A premix beverage dispensing apparatus comprising a product source station for providing at least one premixed beverage, a tower assembly, cooling means therein for chilling said premixed beverage downstream of said source station, at least one drink dispensing valve and conduit means for interconnecting said source station and said dispensing valve, said conduit means including an inlet end adjacent said source station and an outlet side within said tower assembly extending from said cooling means to an outlet end adjacent said valve, said outlet side fixed in an insulation block, said dispensing valve including a threaded socket, adapter means for connecting said valve to said outlet end including plug-in connector means for connecting said outlet end to said dispensing valve, said plug-in connector means rigidly fixed in said insulation block.

52. A premix beverage dispensing apparatus including a product source station for providing at least one premixed beverage, a tower assembly, cooling means for chilling said premixed beverage downstream of said source station, at least one drink dispensing valve and conduit means for interconnecting said source station and said dispensing valve, said conduit means including an inlet end adjacent said source station and an outlet side within said tower assembly extending from said cooling means to an outlet end adjacent said valve, said outlet side fixed in an insulation block, said dispensing valve including a dispensing end and an opposite connection end, the improvement comprising: adapter means for connecting said valve connection end to said outlet end, including a plug-in connector and an adapter fitting, said plug-in connector fixed at either of said outlet end or said connection end, said adapter fitting interconnecting said plug-in connector and the other of said outlet end or said connection end.

53. The beverage dispenser of claim 52, wherein said plug-in connector is fixed at said outlet end of said beverage conduit.

54. The beverage dispenser of claim 53, wherein said valve includes a threaded socket at said connection end and said adapter fitting includes a threaded nipple portion engaging with said threaded socket.

55. The beverage dispenser of claim 54, wherein said adapter fitting further includes receptacle means for receiving said plug-in connector therein.

56. The beverage dispenser of claim 55, wherein said receptacle means includes a cylindrical receptacle opening.

57. The beverage dispenser of claim 54, wherein said adapter means connects said valve and said beverage conduit along a dispensing axis, said adapter fitting further including a head portion axially opposite said nipple portion, said head portion including a receptacle means for receiving said plug-in connector.

58. The beverage dispenser of claim 53, said dispensing apparatus including means for accessing said valve between said dispensing end and said connection end for rotation or removal of said dispensing end from said beverage dispensing apparatus.

59. The beverage dispenser of claim 58, further including a preassembly plate and edge walls extending therefrom, said preassembly plate attached to said tower assembly via said edge walls, said dispensing end attached to said preassembly plate.

60. The beverage dispenser of claim 59, wherein said means for accessing said valve includes an opening located between said tower assembly and said preassembly plate.

61. The beverage dispenser of claim 52, wherein said adapter fitting includes receptacle means for receiving said plug-in connector therein.

62. The beverage dispenser of claim 61, wherein said receptacle means includes a cylindrical receptacle opening, said plug-in connector fitted therein.

63. The beverage dispenser of claim 61, wherein said plug-in connector includes an outer surface and an O-ring disposed thereon.

64. The beverage dispenser of claim 61, wherein said plug-in connector includes a flange end at its outlet, an outer surface and a circumferential groove in said outer surface adjacent said flange end of said connector.

65. The beverage dispenser of claim 64, wherein an O-ring is disposed within said circumferential groove.

66. The beverage dispenser of claim 61, wherein said valve includes a threaded socket at said connection end and said threaded socket includes a gasket disposed therein.

67. The beverage dispenser of claim 66, wherein said adapter fitting includes a threaded nipple portion engaging with said threaded socket.

68. The beverage dispenser of claim 52, wherein said plug-in connector includes a flange end at its outlet and further includes a circumferential groove adjacent said flange end.

69. The beverage dispenser of claim 68, wherein an O-ring is disposed within said circumferential groove.

70. The beverage dispenser of claim 52, wherein said plug-in connector includes a flange end at its outlet, an outer surface and an O-ring disposed on said outer surface adjacent said flange end.

71. The beverage dispenser of claim 52, said dispensing apparatus including means for accessing said valve between said dispensing end and said connection end for rotation or removal of said dispensing end from said beverage dispensing apparatus.

72. The beverage dispenser of claim 71, further including a preassembly plate and edge walls extending therefrom, said preassembly plate attached to said tower assembly via said edge walls, said dispensing end attached to said preassembly plate.

73. The beverage dispenser of claim 72, wherein said means for accessing said valve includes an opening located between said tower assembly and said preassembly plate.

* * * * *